US005977046A

United States Patent [19]

Warr

[11] Patent Number: 5,977,046

[45] **Date of Patent: *Nov. 2, 1999**

[54] DETERGENT COMPOSITION

[75] Inventor: Jonathan Frank Warr, Port Sunlight, United Kingdom

[73] Assignee: Lever Brothers Company, Division of Conopco, Inc., New York, N.Y.

[ * ] Notice: This patent issued on a continued prosecution application filed under 37 CFR 1.53(d), and is subject to the twenty year patent term provisions of 35 U.S.C. 154(a)(2).

[21] Appl. No.: 08/760,617

[22] Filed: Dec. 4, 1996

[30] Foreign Application Priority Data

Dec. 21, 1995 [GB] United Kingdom ..... 9526181

[51] Int. Cl.[6] ..... C11D 3/37; C11D 1/83

[52] U.S. Cl. ..... 510/340; 510/356; 510/360; 510/475

[58] Field of Search ..... 510/355, 356, 510/358, 360, 475, 340

[56] References Cited

U.S. PATENT DOCUMENTS

| | | | |
|---|---|---|---|
| 5,451,341 | 9/1995 | White | 252/547 |
| 5,466,802 | 11/1995 | Panandiker et al. | 544/193.2 |
| 5,500,154 | 3/1996 | Bacon et al. | 252/551 |
| 5,604,197 | 2/1997 | Busch et al. | 510/516 |
| 5,629,278 | 5/1997 | Baeck et al. | 510/236 |

FOREIGN PATENT DOCUMENTS

| | | |
|---|---|---|
| 0262897 | 9/1987 | European Pat. Off. . |
| 0372291 | 6/1990 | European Pat. Off. . |
| 635565 | 1/1995 | European Pat. Off. . |
| 635566 | 1/1995 | European Pat. Off. . |
| 663438 | 7/1995 | European Pat. Off. . |
| 4312648 | 10/1994 | Germany . |
| 92/04437 | 3/1992 | WIPO . |
| 95/07336 | 3/1995 | WIPO . |
| 95/27038 | 10/1995 | WIPO . |

OTHER PUBLICATIONS

International Search Report, dated Mar. 13, 1997,.

Research Disclousre, No. 377, pp. 609–611, BASF, "Use of Cross Linked Copolymers as Color Transfer Inhibitors in Detergents".

*Primary Examiner*—Yogendra Gupta
*Assistant Examiner*—John R. Hardee
*Attorney, Agent, or Firm*—Neil Y. Gilbert, Esq.

[57] ABSTRACT

A detergent composition suitable for washing colored fabrics. The composition comprises:

a) a N-vinylimidazole N-vinylpyrrolidone copolymer (PVP/PVI) in an amount effective to inhibit dye transfer between fabrics during the wash; and b) an organic surfactant system comprising
(i) alkylbenzene sulphonate,
(ii) a nonionic surfactant
in which the ratio of (i) to (ii) is from 7:3 to 99:1.

13 Claims, No Drawings

DETERGENT COMPOSITION

TECHNICAL FIELD

The present invention relates to a detergent composition and to a process for inhibiting dye transfer between fabrics during washing, in particular the invention relates to detergent compositions containing N-vinylimidazole N-vinylpyrrolidone copolymers.

BACKGROUND OF THE INVENTION

There is a tendency during the laundering of fabrics for coloured fabrics to release dye into the wash solution. This is a most persistent and troublesome problem as this released dye can then be transferred onto other fabrics. A fabric treatment composition comprising an agent which could prevent the transfer of dye would therefore prove useful.

EP 462 806 (Unilever) discloses a domestic treatment of a fabric with a cationic dye fixing agent to reduce the amount of dye released from the fabric. Suitable cationic dye fixing agents include the dimethyldiallyl ammonium chloride polymer.

Surfactant containing dye transfer inhibiting compositions are disclosed in EP 0 587 550 (Procter and Gamble). The dye transfer inhibition agent is a polymer selected from polyamine N oxide containing polymers.

EP 0 327 927 (Procter and Gamble) describes a granular detergent additive comprising water-soluble polymeric compounds based on N-vinylpyrolidone and/or N-vinylimidazole and/or N-vinyloxazolidine and cationic compounds.

Detergent compositions comprising a N-vinylimidazole N-vinylpyrolidone copolymer are disclosed in EP 0 635 566 (Procter and Gamble). EP 0 635 566 teaches that surfactant systems excluding alkylbenzene sulphonate exhibit good dye transfer inhibition properties. However omission of LAS is detrimental to detergency.

The present invention has now found that dye transfer can be inhibited without loss of detergency by the use of selected levels of alkyl benzene sulphonate and a N-vinylimidazole N-vinylpyrrolidone copolymer. In addition to the prevention of dye transfer the formulations of the present invention exhibit excellent soil anti-redeposition properties and are high foaming. The formulations of the present invention are also particularly good at removing particulate and protein based soils from fabrics.

DEFINITION OF THE INVENTION

Accordingly the present application relates to a detergent composition suitable for washing coloured fabrics, the composition comprises:

a) a N-vinylimidazole N-vinylpyrrolidone copolymer (PVP/PVI)in an amount effective to inhibit dye transfer between fabrics during the wash.

b) an organic surfactant system comprising
   (i) alkylbenzene sulphonate,
   (ii) a nonionic surfactant;

in which the ratio of (i) to (ii) is from 7:3 to 99:1.

The invention also refers to the use of a detergent composition as described above to reduce the amount of dye transfer between coloured fabrics in the wash.

DETAILED DESCRIPTION OF THE INVENTION

The compositions of the invention will contain detergent-active compounds (surfactants) and generally detergency builders, and may optionally contain bleaching components and other active ingredients to enhance performance and properties. They also contain a dye transfer inhibiting N-vinylimidazole N-vinylpyrrolidine copolymer.

Detergent Active Compounds

The detergent compositions of the invention will contain, as essential ingredients, two or more detergent-active compounds (surfactants) which may be chosen from soap and non-soap anionic, cationic, nonionic, amphoteric and zwitterionic detergent-active compounds, and mixtures thereof. Many suitable detergent-active compounds are available and are fully described in the literature, for example, in "Surface-Active Agents and Detergents", Volumes I and II, by Schwartz, Perry and Berch.

The preferred detergent-active compounds that can be used are soaps and synthetic non-soap anionic and nonionic compounds.

The detergent compositions of the invention contain alkyl benzene sulphonate as an essential ingredient. It is preferred if they contain linear alkylbenzene sulphonate, particularly linear alkylbenzene sulphonates having an alkyl chain length of $C_8$–$C_{15}$.

It is preferred if the level of alkylbenzene sulphonate is from 5 wt % to 50 wt %, more preferably 10 wt % to 40 wt %, most preferably from 15 wt % to 35 wt %.

In addition to alkylbenzene sulphonate the detergent compositions of the invention may contain other anionic surfactants in amounts additional to the percentages quoted above. Suitable anionic surfactants are well-known to those skilled in the art. Examples include primary and secondary alkyl sulphates, particularly $C_8$–$C_{15}$ primary alkyl sulphates; alkyl ether sulphates; olefin sulphonates; alkyl xylene sulphonates; dialkyl sulphosuccinates; and fatty acid ester sulphonates. Sodium salts are generally preferred.

The compositions of the invention also contain nonionic surfactant as an essential ingredient.

Nonionic surfactants that may be used include the primary and secondary alcohol ethoxylates, especially the $C_8$–$C_{20}$ aliphatic alcohols ethoxylated with an average of from 1 to 20 moles of ethylene oxide per mole of alcohol, and more especially the $C_{10}$–$C_{15}$ primary and secondary aliphatic alcohols ethoxylated with an average of from 1 to 10 moles of ethylene oxide per mole of alcohol. Non-ethoxylated nonionic surfactants include alkylpolyglycosides, glycerol monoethers, and polyhydroxyamides (glucamide).

It is preferred if the level of nonionic surfactant is from 1 wt % to 15 wt %.

The ratio of alkylbenzene sulphonate to nonionic surfactant is from 7:3 to 90:1, preferably 3:1 to 99:1, most preferably 3:1 to 90:1.

The choice of detergent-active compound (surfactant), and the amount present, will depend on the intended use of the detergent composition. In fabric washing compositions, different surfactant systems may be chosen, as is well known to the skilled formulator, for handwashing products and for products intended for use in different types of washing machine.

If a high foaming product is desired it is preferable to use nonionic surfactants that are not ethoxylated such as cocomonoethanolamide.

The total amount of surfactant present will also depend on the intended end use and may be as high as 60 wt %, for example, in a composition for washing fabrics by hand. In compositions for machine washing of fabrics, an amount of from 5 to 40 wt % is generally appropriate.

Detergent compositions suitable for use in most automatic fabric washing machines generally contain anionic non-soap surfactant, or nonionic surfactant, or combinations of the two in any ratio, optionally together with soap.

The N-vinylimidazole N-vinylpyrrolidone Copolymer

The present invention comprises as an essential detergent ingredient a polymer selected from the N-vinylimidazole N-vinylpyrrolidone copolymers.

The N-vinylimidazole N-vinylpyrrolidone polymers have an average molecular weight range from 5000–1,000,000, preferably from 20,000–200,000.

Highly preferred polymers for use in detergent compositions according to the present invention comprise a polymer selected from N-vinylimidazole N-vinylpyrrolidone copolymers wherein said polymer has an average molecular weight range from 5,000 to 200,000 more preferably from 10,000 to 100,000, most preferably from 20,000 to 70,000.

The average molecular weight range can be determined by light scattering as described in Barth H. G. and Mays J. W. Chemical Analysis Vol 113. "Modern Methods of Polymer Characterisation".

The N-vinylimidazole N-vinylpyrrolidone copolymers characterised by having said average molecular weight range provide excellent dye transfer inhibiting properties while not adversely affecting the cleaning performance of detergent compositions formulated therewith.

The N-vinylimidazole N-vinylpyrrolidone copolymer of the present invention has a molar ratio of N-vinylimidazole to N-vinylpryrrolidone from 5 to 0.2.

The N-vinylimidazole N-vinylpyrrolidone copolymers can be linear or branched. The level of the N-vinylimidazole N-vinylpryrrolidone present in the detergent compositions is from 0.01 to 10%, more preferably from 0.05 to 5%, most preferably form 0.1 to 1% by weight of the detergent composition.

N-vinylimidazole N-vinylpyrrolidone copolymers can be used in conjunction with other dye transfer inhibiting polymers or copolymers (e.g. polyvinyl pryrolidone or polyvinyl pyridine N-oxide).

Detergency Builders

The detergent compositions of the invention will generally also contain one or more detergency builders. The total amount of detergency builder in the compositions will suitably range from 5 to 80 wt %, preferably from 10 to 60 wt %.

Inorganic builders that may be present include sodium carbonate, if desired in combination with a crystallisation seed for calcium carbonate, as disclosed in GB 1 437 950 (Unilever); crystalline and amorphous aluminosilicates, for example, zeolites as disclosed in GB 1 473 201 (Henkel), amorphous aluminosilicates as disclosed in GB 1 473 202 (Henkel) and mixed crystalline/amorphous aluminosilicates as disclosed in GB 1 470 250 (Procter & Gamble); and layered silicates as disclosed in EP 164 514B (Hoechst). Inorganic phosphate builders, for example, sodium orthophosphate, pyrophosphate and tripolyphosphate are also suitable for use with this invention.

The detergent compositions of the invention preferably contain an alkali metal, preferably sodium, aluminosilicate builder. Sodium aluminosilicates may generally be incorporated in amounts of from 10 to 70% by weight (anhydrous basis), preferably from 25 to 50 wt %.

The alkali metal aluminosilicate may be either crystalline or amorphous or mixtures thereof, having the general formula:

$$0.8\text{–}1.5\ Na_2O.Al_2O_3.0.8\text{–}6\ SiO_2$$

These materials contain some bound water and are required to have a calcium ion exchange capacity of at least 50 mg CaO/g. The preferred sodium aluminosilicates contain 1.5–3.5 $SiO_2$ units (in the formula above). Both the amorphous and the crystalline materials can be prepared readily by reaction between sodium silicate and sodium aluminate, as amply described in the literature.

Suitable crystalline sodium aluminosilicate ion-exchange detergency builders are described, for example, in GB 1 429 143 (Procter & Gamble). The preferred sodium aluminosilicates of this type are the well-known commercially available zeolites A and X, and mixtures thereof.

The zeolite may be the commercially available zeolite 4A now widely used in laundry detergent powders. However, according to a preferred embodiment of the invention, the zeolite builder incorporated in the compositions of the invention is maximum aluminium zeolite P (zeolite MAP) as described and claimed in EP 384 070A (Unilever). Zeolite MAP is defined as an alkali metal aluminosilicate of the zeolite P type having a silicon to aluminium ratio not exceeding 1.33, preferably within the range of from 0.90 to 1.33, and more preferably within the range of from 0.90 to 1.20.

Especially preferred is zeolite MAP having a silicon to aluminium ratio not exceeding 1.07, more preferably about 1.00. The calcium binding capacity of zeolite MAP is generally at least 150 mg CaO per g of anhydrous material.

Organic builders that may be present include polycarboxylate polymers such as polyacrylates, acrylic/maleic copolymers, and acrylic phosphinates; monomeric polycarboxylates such as citrates, gluconates, oxydisuccinates, glycerol mono-, di- and trisuccinates, carboxymethyloxysuccinates, carboxymethyloxymalonates, dipicolinates, hydroxyethyliminodiacetates, alkyl- and alkenylmalonates and succinates; and sulphonated fatty acid salts. This list is not intended to be exhaustive.

Especially preferred organic builders are citrates, suitably used in amounts of from 5 to 30 wt %, preferably from 10 to 25 wt %; and acrylic polymers, more especially acrylic/maleic copolymers, suitably used in amounts of from 0.5 to 15 wt %, preferably from 1 to 10 wt %.

Builders, both inorganic and organic, are preferably present in alkali metal salt, especially sodium salt, form.

Bleach Components

Detergent compositions according to the invention may also suitably contain a bleach system. Fabric washing compositions may desirably contain peroxy bleach compounds, for example, inorganic persalts or organic peroxyacids, capable of yielding hydrogen peroxide in aqueous solution.

Suitable peroxy bleach compounds include organic peroxides such as urea peroxide, and inorganic persalts such as the alkali metal perborates, percarbonates, perphosphates, persilicates and persulphates. Preferred inorganic persalts are sodium perborate monohydrate and tetrahydrate, and sodium percarbonate.

Especially preferred is sodium percarbonate having a protective coating against destabilisation by moisture. Sodium percarbonate having a protective coating comprising sodium metaborate and sodium silicate is disclosed in GB 2 123 044B (Kao).

The peroxy bleach compound is suitably present in an amount of from 0.1 to 35 wt %, preferably from 0.5 to 25 wt %.

The peroxy bleach compound may be used in conjunction with a bleach activator (bleach precursor) to improve bleaching action at low wash temperatures. The bleach precursor is suitably present in an amount of from 0.1 to 8 wt %, preferably from 0.5 to 5 wt %.

Preferred bleach precursors are peroxycarboxylic acid precursors, more especially peracetic acid precursors and pernonanoic acid precursors. Especially preferred bleach precursor suitable for use in the present invention are N,N,N',N'-tetracetyl ethylenediamine (TAED) and sodium nonanoyloxybenzene sulphonate (SNOBS). The novel quaternary ammonium and phosphonium bleach precursors disclosed in U.S. Pat. No. 4,751,015 and U.S. Pat. No. 4,818,426 (Lever Brothers Company) and EP 402 971A (Unilever) are also of great interest. The cationic bleach precursors disclosed in EP 284 292A and EP 303 520A (Kao) may also be used.

The bleach system can be either supplemented with or replaced by a peroxyacid. Examples of such peracids can be found in U.S. Pat. No. 4,686,063 and U.S. Pat. No. 5,397,501 (patent on TPCAP-Unilever). A preferred example is the imido peroxycarboxylic class of peracids described in EP A 325 288, EP A 349 940, DE 382 3172 and EP 325 289. A particularly preferred example is phtalimido peroxy caproic acid (PAP). Such peracids are suitably present at 0.1–12%, preferably 0.5–10%.

A bleach stabiliser (heavy metal sequestrant) may also be present. Suitable bleach stabilisers include ethylenediamine tetraacetate (EDTA), the polyphosphonates such as Dequest (Trade Mark) and non-phosphate stabilisers such as EDDS (ethylene diamine di-succinic acid). These Bleach stabilisers are also useful for stain removal, especially in products containing low levels of bleaching species or no bleaching species.

An especially preferred bleach system comprises a peroxy bleach compound (preferably sodium percarbonate optionally together with a bleach activator), and a transition metal bleach catalyst as described and claimed in EP 458 397A, EP 458 398A and EP 509 787A (Unilever).

The Enzyme

Suitable enzymes include the proteases, amylases, cellulases, oxidases, peroxidases and lipases usable for incorporation in detergent compositions.

Preferred proteolytic enzymes (proteases) are, catalytically active protein materials which degrade or alter protein types of stains when present as in fabric stains in a hydrolysis reaction. They may be of any suitable origin, such as vegetable, animal, bacterial or yeast origin.

Proteolytic enzymes or proteases of various qualities and origins and having activity in various pH ranges of from 4–12 are available and can be used in the instant invention. Examples of suitable proteolytic enzymes are the subtilisins, which are obtained from particular strains of *B. subtilis* and *B. licheniformis*, such as the commercially available subtilisins Maxatase (Trade Mark), as supplied by Gist-Brocades N. V., Delft, Holland, and Alcalase (Trade Mark), as supplied by Novo Industri A/S, Copenhagen, Denmark.

Particularly suitable is a protease obtained from a strain of Bacillus having maximum activity throughout the pH range of 8–12, being commercially available, e.g. from Novo Industri A/S under the registered trade-names Esperase (Trade Mark) and Savinase (Trade-Mark). The preparation of these and analogous enzymes is described in GB 1 243 785. Other commercial proteases are Kazusase (Trade Mark) (obtainable from Showa-Denko of Japan), Optimase (Trade Mark) (from Miles Kali-Chemie, Hannover, West Germany), and Superase (Trade Mark) (obtainable from Pfizer of U.S.A.).

Detergency enzymes are commonly employed in granular form in amounts of from about 0.1 to about 3.0 wt %.

Other Ingredients

The compositions of the invention may contain alkali metal, preferably sodium, carbonate, in order to increase detergency and ease processing. Sodium carbonate may suitably be present in amounts ranging from 1 to 60 wt %, preferably from 2 to 40 wt %. However, compositions containing little or no sodium carbonate are also within the scope of the invention.

Powder flow may be improved by the incorporation of a small amount of a powder structurant, for example, a fatty acid (or fatty acid soap), a sugar, an acrylate or acrylate/maleate polymer, or sodium silicate.

One preferred powder structurant is fatty acid soap, suitably present in an amount of from 1 to 5 wt %.

Other materials that may be present in detergent compositions of the invention include sodium silicate; antiredeposition agents such as cellulosic polymers; inorganic salts such as sodium sulphate; lather control agents or lather boosters as appropriate; proteolytic and lipolytic enzymes; dyes; coloured speckles; perfumes; foam controllers; fabric softening compounds, soil release polymers, fluorescers and decoupling polymers. This list is not intended to be exhaustive.

The detergent composition when diluted in the wash liquor (during a typical wash cycle) will give a pH of the wash liquor from 7 to 10.5.

The detergent components of the present invention may be incorporated in detergent compositions of all physical types, for example, powders, liquids, gels and solid bars.

Detergent compositions of the invention may be prepared by any suitable method.

Particulate detergent compositions are suitably prepared by spray-drying a slurry of compatible heat-insensitive ingredients, and then spraying on or postdosing those ingredients unsuitable for processing via the slurry. The skilled detergent formulator will have no difficulty in deciding which ingredients should be included in the slurry and which should not.

Particulate detergent compositions of the invention preferably have a bulk density of at least 400 g/l, more preferably at least 500 g/l.

Especially preferred compositions have bulk densities of at least 650 g/liter, more preferably at least 700 g/liter.

Such powders may be prepared either by post-tower densification of spray-dried powder, or by wholly non-tower methods such as dry mixing and granulation; in both cases a high-speed mixer/granulator may advantageously be used.

Processes using high-speed mixer/granulators are disclosed, for example, in EP 340 013A, EP 367 339A, EP 390 251A and EP 420 317A (Unilever).

Liquid detergent compositions can be prepared by admixing the essential and optional ingredients thereof in any desired order to provide compositions containing components in the requisite concentrations. Liquid compositions according to the present invention can also be in compact form which means it will contain a lower level of water compared to a conventional liquid detergent.

EXAMPLES

The invention will now be illustrated by the following non-limiting examples. In the examples all percentages are expressed by weight.

Comparative Examples are designated by letters, while Examples of the invention are designated by numbers.

Preparation of the Detergent Compositions

Examples were prepared according to standard procedures for that product type.

100 ml of wash solution was prepared using demineralised water, containing 10 $\mu$M/l of dye, such that 43.5 mg/l of PVP/PVI was dissolved and 1 g/l of the total level of surfactant was dissolved in the wash solution. To this wash solution a white cotton swatch (2.5 g, 13×13 cm white desized mercerised cotton sheeting) was added. The fabrics were agitated in the wash solution for 30 minutes. The fabrics were rinsed in demineralised water twice, spun dried, then tumble dried. The reflectance values of the dry clothes were measured on an ICS Texicon Spectraflash 500 (Trademark) spectrophotometer.

The data thereby obtained was transferred to the CIELAB L*a*b* colour space parameters. In this colour space, L* indicates lightness and a* and b* are the chromaticity coordinates.

The colour differences between the washed swatch and a untreated white swatch was expressed as ΔE, calculated from the following equation:

$$(\Delta E) = \sqrt{(\Delta L)^2 + (\Delta a)^2 + (\Delta b)^2}$$

The colour difference (ΔE) obtained by the above method was calculated using the Flash 500 programme and are given below.

As stated above the PVP/PVI level remained constant in all the Examples.

Compositions were made up with the linear alkylbenzene sulphonate (LAS)/nonionic ratios listed below:

TABLE 1

| Example | Ratio of LAS/Nonionic | ΔE Value dye direct red 80 | ΔE Value dye solophenyl blue FGLE |
|---|---|---|---|
| A | 100 LAS*5 | 15.48 | 11.95 |
| 1 | 90:10 LAS:nonionic*1 | 11.70 | 8.66 |
| 2 | 75:25 LAS:nonionic*1 | 5.52 | 5.10 |
| 3 | 90:10 LAS:APG*2 | 13.21 | 9.61 |
| 4 | 75:25 LAS:APG*2 | 8.88 | 6.73 |
| 5 | 90:10 LAS:nonionic*3 | 11.18 | 8.16 |
| 6 | 75:25 LAS:nonionic*3 | 4.86 | 4.24 |
| 7 | 90.10 LAS:CLBA*4 | 13.48 | 9.82 |
| 8 | 75.25 LAS:CLBA*4 | 8.46 | 6.42 |

Table 2 and Table 3 demonstrate the advantage of the invention in fully formulated products.

TABLE 2

| | Examples | | | | | |
|---|---|---|---|---|---|---|
| Component | B | C | D | 9 | 10 | 11 |
| Water | to 100% wt | | | | | |
| Sodium hydroxide | 6.7 | 5.2 | 6.7 | 5.2 | 5.2 | 5.2 |
| Tri sodium citrate | 10.0 | 10.0 | 10.0 | 10.0 | 10.0 | 10.0 |
| Zeolite 4A | 20.0 | 20.0 | 20.0 | 20.D | 20.0 | 20.0 |
| Narlex DC1 | 1.0 | 1.0 | 1.0 | 1.0 | 1.0 | 1.0 |
| LAS | 26.6 | 21.0 | 26.6 | 21.0 | 21.0 | 21.0 |
| Synperonic A7 | — | 5.6 | — | 5.6 | 5.6 | 5.6 |
| PVP/PVI | — | — | 0.25 | 0.25 | 0.5 | 1.0 |
| ΔE direct red | 24.8 | 23.7 | 24.2 | 15.6 | 13.4 | 12.1 |

Formulations according to Table 3 were prepared and added to the wash solution at a level of 3.8 g of total formulation per liter.

TABLE 3

| | Level Weight % | | | | | |
|---|---|---|---|---|---|---|
| Component | E | 12 | 13 | 14 | 15 | 16 |
| LAS | 25 | 21.6 | 21.6 | 21.6 | 21.6 | 21.6 |
| Ethoxylated alcohol (25-7) | 0 | 2.4 | 2.4 | 2.4 | 2.4 | 0 |
| Coco mono-ethanolamide | 0 | 0 | 0 | 0 | 0 | 2.4 |
| Sodium tri polyphosphate | 21.7 | 19.6 | 18.5 | 15.6 | 18.8 | 18.8 |
| Sodium silicate | 5.0 | 5.0 | 5.0 | 5.0 | 5.0 | 5.0 |
| Calcite | 10.0 | 10.0 | 10.0 | 16.6 | 10.0 | 10.0 |
| Sodium carboxy methyl cellulite | 0.7 | 0.7 | 0.7 | 0.7 | 0.7 | 0.7 |
| Sodium sulphate | 21.0 | 25.3 | 26.9 | 23.0 | 26.2 | 26.0 |
| Acrylic maleic co-polymer | 1.80 | 0.5 | — | — | 1.2 | 1.2 |
| PVP/PVI | 0 | 0.1 | 0.2 | 0.3 | 0.1 | 0.1 |
| Zeolite | 1.20 | 1.20 | 1.20 | 1.2 | 1.2 | 1.2 |
| Perfume + minors + water | to 100 wt. % | | | | | |
| ΔE Value* | 119 | 94 | 92 | 93 | 99 | 101 |

*Total value of tests performed with 6 dyes, the dyes being Eemazd Black B" "Procion Turquoise HA", "Procion Tricheme", "Direct Red 80", "Solophenyl Blue" and Solophenyl Black.

I claim:

1. A detergent composition suitable for washing coloured fabrics, the composition comprising:

a) a N-vinylimidazole N-vinylpyrrolidone copolymer (PVP/PVI) in an amount effective to inhibit dye transfer between fabrics during the wash; and b) an organic surfactant system comprising:

(i) alkylbenzene sulphonate; and (ii) a nonionic surfactant selected from the group consisting of alkyl polyglucosides, ethoxylated fatty alcohols, polyhydroxy amides, and mixtures thereof, wherein said nonionic surfactant is the total quantity of nonionic surfactant in said detergent composition;

in which the weight ratio of said alkylbenezene sulphonate (i) to said total quantity of nonionic surfactant (ii) in said detergent composition is from 75:25 to 90:10.

2. A detergent composition according to claim 1 in which the ratio of alkyl benzene sulphonate to nonionic surfactant is from 3:1 to 90:1.

3. A detergent composition according to claim 1 in which the nonionic surfactant is a $C_8$–$C_{20}$ aliphatic alcohol ethoxylated with an average of from 1 to 20 moles of ethylene oxide per mole of alcohol.

4. A detergent composition according to claim 1 in which the level of alkyl benzene sulphonate is from 10 wt % to 40 wt % of the total composition.

5. A detergent composition according to claim 1 in which the level of nonionic surfactant is from 1 wt % to 15 wt % of the total composition.

6. A detergent composition according to claim 1 in which the total level of detergent surfactant is 60 wt % or less of the total composition.

7. A detergent composition according to claim 1 in which the level of the copolymer is from 0.01 wt % to 10 wt % of the total composition.

8. A detergent composition according to claim 1 in which the average molecular weight range of the copolymer is from 10,000 to 100,000.

9. A detergent composition according to claim 7 in which the average molecular weight range is from 20,000 to 70,000.

10. A detergent composition according to claim 1 which is in liquid form.

11. A detergent composition according to claim 1 which is in granular or powdered form.

12. A detergent composition according to claim 1 wherein the nonionic surfactant is a non-ethoxylated nonionic surfactant selected from the group consisting of alkyl polyglucosides and polyhydroxyamides.

13. A detergent composition according to claim 1 wherein the nonionic surfactant is linear alkyl sulfate and alkyl polyglucoside.

* * * * *